US011624312B2

(12) United States Patent
Park et al.

(10) Patent No.: US 11,624,312 B2
(45) Date of Patent: Apr. 11, 2023

(54) RESERVOIR TANK FOR VEHICLE

(71) Applicants: Hyundai Motor Company, Seoul (KR); Kia Corporation, Seoul (KR)

(72) Inventors: Jong Il Park, Hwaseong-si (KR); Yong Woong Cha, Yongin-si (KR); Joong Su Yun, Uiwang-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/679,725

(22) Filed: Feb. 24, 2022

(65) Prior Publication Data

US 2022/0298958 A1 Sep. 22, 2022

(30) Foreign Application Priority Data

Mar. 19, 2021 (KR) ..... 10-2021-0035639

(51) Int. Cl.
*F01P 11/02* (2006.01)
*F01P 11/04* (2006.01)

(52) U.S. Cl.
CPC ..... *F01P 11/029* (2013.01); *F01P 11/04* (2013.01)

(58) Field of Classification Search
CPC ..... F01P 11/029; F01P 11/04; F01P 11/02; F01P 11/028; F01P 11/0285
See application file for complete search history.

(56) References Cited

U.S. PATENT DOCUMENTS

2022/0282926 A1* 9/2022 Nishioka ..... F28F 9/0278

* cited by examiner

*Primary Examiner* — Jacob M Amick
(74) *Attorney, Agent, or Firm* — Morgan, Lewis & Bockius LLP

(57) ABSTRACT

A reservoir tank includes a tank portion having a cover coupled to an upper portion thereof, and having coolants with different temperatures supplied thereto, a heat exchange reduction portion partitioning an internal space of the tank portion into a first accommodation space and a second accommodation space, and having the first accommodation space and the second accommodation space formed to be spaced from each other, and a discharge portion formed in the heat exchange reduction portion and formed to allow coolant flowing into the heat exchange reduction portion to be discharged back to the first accommodation space and the second accommodation space, respectively.

10 Claims, 2 Drawing Sheets

[FIG. 1]
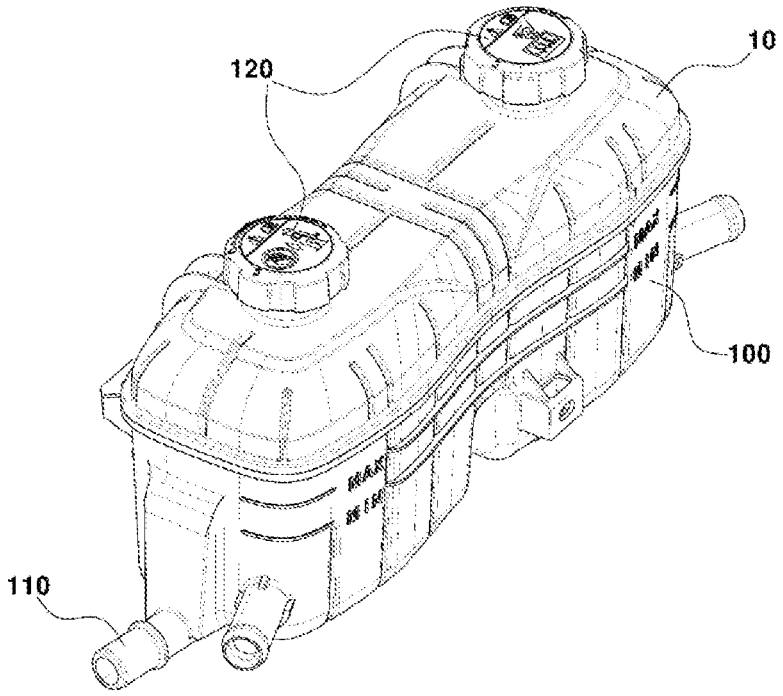
[FIG. 2]
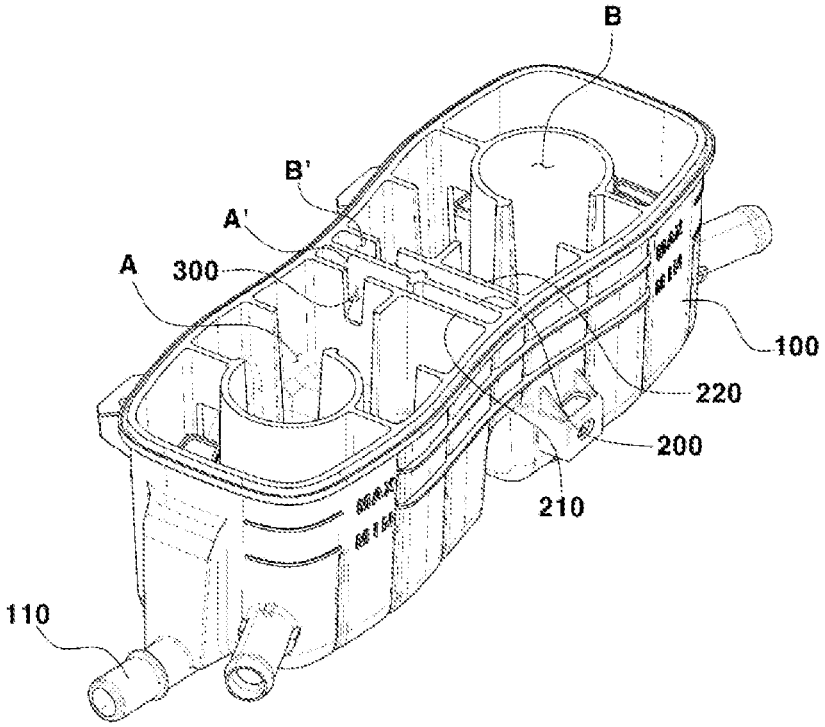

[FIG. 3]
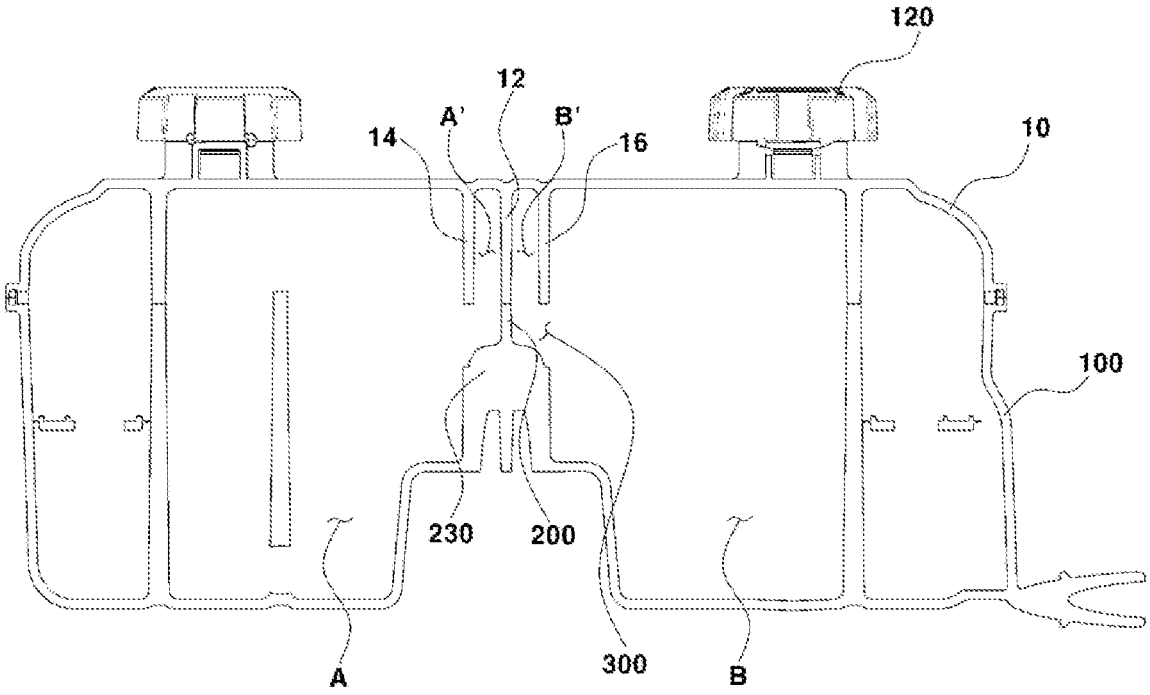
[FIG. 4]
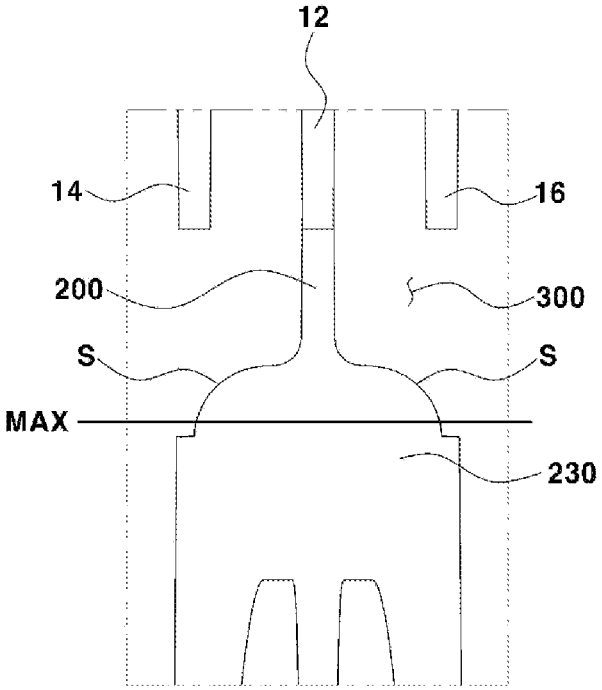

RESERVOIR TANK FOR VEHICLE

CROSS-REFERENCE TO RELATED APPLICATION

The present application claims priority to Korean Patent Application No. 10-2021-0035639 filed on Mar. 19, 2021, the entire contents of which is incorporated herein for all purposes by this reference.

BACKGROUND OF THE INVENTION

Field of the Invention

The present invention relates to a reservoir tank for a vehicle, and more specifically, to a reservoir tank for a vehicle, which may integrate a plurality of reservoir tanks in which coolants having different temperatures are accommodated, respectively, to satisfy cooling performance of different components, reducing the weight and material cost of the reservoir tank.

Description of Related Art

Generally, in a vehicle mounted with an internal combustion engine, a temperature of the heat generated upon heating an engine reaches a high temperature of about 1,500° C. or more, and when the present heat is delivered to a cylinder head, a piston, a valve, etc. as it is, due to a thermal expansion or deterioration as the temperature of these components excessively increase, the component is deformed, an oil film of lubricant is destroyed, and the lubricant is insufficient, and a combustion state also deteriorates, resulting in knocking or early ignition, and therefore, an output of the engine is reduced, and in a severe case, an overheating phenomenon of the engine causing an inoperable state occurs.

Furthermore, unlike such a situation, in case of a supercooling state where the temperature of the engine is very low, gasoline of an atomized mixed gas drawn in into a cylinder is not sufficiently gasified, and the combustion state is poor and therefore, a fuel amount consumed increases, and the non-combustion gasoline remains in a cylinder wall, causing lubricant to be sparse and affecting the operation and durability of the engine.

Therefore, a cooling system is provided in a vehicle to maintain a temperature most suitable for the operation of the engine.

The cooling system is classified into an air-cooled type locating outside air around the engine to cool the engine at a high temperature, and a water-cooled type circulating coolant around a combustion chamber of the engine to cool the hot engine, and the vehicle mainly utilizes the water-cooled type having the excellent cooling effect because the air-cooled type has cooling performance lower than that of the water-cooled type.

Generally, a cooling system using coolant includes an engine having a cylinder head, a coolant passage, and a combustion chamber, a radiator configured to cool water whose temperature is increased in the engine, a cooling fan configured to draw air through the radiator to assist the ventilation of the radiator, a water pump configured to supply the water cooled by the radiator back to the coolant passage of the engine, and a reservoir tank provided in the coolant passage.

Such a reservoir tank stores a constant amount of coolant, and continuously discharges air bubbles generated in the radiator and an engine system and generated in the coolant passage, and supplies a constant amount of coolant to the water pump to prevent a negative pressure of a coolant system from being generated.

However, for example, in case of an electric vehicle, the reservoir tank may be provided separately because the type and temperature condition of the coolant required by a cooling circuit for cooling electronic parts, and the type and temperature condition of the coolant required by a cooling circuit for cooling a battery are different from each other.

Therefore, there occurs a problem in that the weight, material cost, and investment cost, etc. of the cooling system are increased due to the increase in the number of reservoir tanks configured to inject and store coolant.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a reservoir tank for a vehicle, which may apply a heat exchange reduction structure to a plurality of reservoir tanks in which coolants having different temperatures are each accommodated to satisfy the cooling performance of different components to integrate the reservoir tanks, reducing the weight and material cost of the reservoir tank, and preventing the reduction in performance due to the heat exchange of coolant in advance.

A reservoir tank for a vehicle according to various exemplary embodiments of the present invention includes a tank portion having a cover coupled to an upper portion thereof, and having coolants with different temperatures supplied thereto, a heat exchange reduction portion partitioning an internal space of the tank portion into a first accommodation space and a second accommodation space, and having the first accommodation space and the second accommodation space formed to be spaced from each other, and a discharge portion provided in the heat exchange reduction portion and formed to allow coolant flowing into the heat exchange reduction portion to be discharged back to the first accommodation space and the second accommodation space, respectively.

Here, the heat exchange reduction portion includes a first partition member forming a boundary with the first accommodation space, a second partition member forming a boundary with the second accommodation space, and a support member supporting the first partition member and the second partition member inside the tank portion.

The discharge portion is formed on each of the first partition member and the second partition member, and the support member is formed to be inclined downward toward the first accommodation space and the second accommodation space, respectively, at a position where the discharge portion is formed.

Furthermore, the support member is formed to be gradually inclined downward toward the discharge portion in an internal space of the first partition member and an internal space of the second partition member.

Furthermore, the discharge portion is formed to have a length from a bottom surface of the support member up to a boundary surface with the cover.

Meanwhile, the discharge portion is formed at a position higher than a maximum coolant line provided in the tank portion to allow an air in the first accommodation space and the second accommodation space to be configured to flow into the heat exchange reduction portion.

The present invention may apply the heat exchange reduction structure to the plurality of reservoir tanks in which coolants having different temperatures are each accommodated to satisfy the cooling performance of different components to integrate the reservoir tanks, reducing the weight and material cost of the reservoir tanks, and preventing the reduction in performance due to the heat exchange of coolant.

Furthermore, the present invention may have the discharge portion in the heat exchange reduction structure, and allow the air in the reservoir tank to flow into the heat exchange reduction structure through the discharge portion to distribute the air required by the reservoir tank to the heat exchange reduction structure, reducing the volume of the reservoir tank.

Furthermore, the present invention may discharge the coolant back into the reservoir tank through the slope of the discharge portion if the coolant flows into the heat exchange reduction structure by the cause, such as the shaking or tilting of the vehicle, also reducing the heat delivery in the heat exchange reduction structure.

It is understood that the term "automotive" or "vehicular" or other similar term as used herein is inclusive of motor automotives in general such as passenger vehicles including sports utility automotives (operation SUV), buses, trucks, various commercial automotives, watercraft including a variety of boats and ships, aircraft, and the like, and includes hybrid automotives, electric automotives, plug-in hybrid electric automotives, hydrogen-powered automotives and other alternative fuel automotives (e.g., fuels determined from resources other than petroleum). As referred to herein, a hybrid automotive is an automotive that has two or more sources of power, for example both gasoline-powered and electric-powered automotives.

The above and other features of the present invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to certain exemplary examples thereof illustrated in of illustration only, and thus are not limitative of the present invention, and wherein FIG. 1 is a diagram illustrating a tank portion of a reservoir tank for a vehicle according to various exemplary embodiments of the present invention.

FIG. 2 is a diagram illustrating the tank portion in a state where a cover of the reservoir tank for the vehicle according to the exemplary embodiment of the present invention is separated.

FIG. 3 is a diagram illustrating a discharge portion of the reservoir tank for the vehicle according to the exemplary embodiment of the present invention.

FIG. 4 is an enlarged diagram illustrating a portion of the reservoir tank for the vehicle according to the exemplary embodiment of the present invention illustrated in FIG. 3.

It may be understood that the appended drawings are not necessarily to scale, presenting a somewhat simplified representation of various features illustrative of the basic principles of the present invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, an exemplary embodiment of the present invention will be described in detail with reference to the accompanying drawings.

Advantages and features of the present invention, and a method for achieving them will be apparent with reference to exemplary embodiments to be described later together with the accompanying drawings.

However, the present invention is not limited by the exemplary embodiment included below but will be implemented in various different forms, and only these embodiments allow the present invention of the present invention to be complete and are provided to fully inform those skilled in the art to which various exemplary embodiments of the present invention pertains of the scope of the present invention, and the present invention is only defined by the scope of the claims.

Furthermore, in the description of the present invention, if it is determined that related known technologies may obscure the gist of the present invention, a detailed description thereof will be omitted.

FIG. 1 is a diagram illustrating a tank portion of a reservoir tank for a vehicle according to various exemplary embodiments of the present invention, and FIG. 2 is a diagram illustrating the tank portion in a state where a cover of the reservoir tank for the vehicle according to the exemplary embodiment of the present invention is separated.

Furthermore, FIG. 3 is a diagram illustrating a discharge portion of the reservoir tank for the vehicle according to the exemplary embodiment of the present invention, and FIG. 4 is an enlarged diagram illustrating a portion of the reservoir tank for the vehicle according to the exemplary embodiment of the present invention illustrated in FIG. 3.

As illustrated in FIG. 1 and FIG. 2, a reservoir tank for a vehicle according to the exemplary embodiment of the present invention includes a tank portion 100, a heat exchange reduction portion 200, and a discharge portion 300.

The reservoir tank corresponding to the tank portion 100 is a storage tank used in a case where a volume of fluid stored is changed depending upon a change in temperature, and a coolant reservoir tank, a clutch oil reservoir tank, a brake oil reservoir tank, an oil reservoir tank of a power steering system, etc. is generally used in the vehicle.

The tank portion 100 is made of a material, such as a plastic, capable of storing a predetermined capacity, and an injection port 110 capable of injecting coolant is formed and a cap 120 configured to open or close the injection port 110 is detachably coupled to the tank portion 100.

Furthermore, the tank portion 100 is formed with the maximum coolant line and the minimum coolant line allowing the level of coolant to be confirmed.

Furthermore, in the tank portion 100, the coolants having different temperatures are supplied to and stored in a first accommodation space A and a second accommodation space B, respectively, and in each tank portion 100, a cover 10 disposed with a cap 120 is coupled to an upper portion of the tank portion 100.

Here, the heat exchange reduction portion 200 is configured to partition the inside of the tank portion 100 such that the first accommodation space A and the second accommodation space B are formed to be space apart from each other.

To the present end, the heat exchange reduction portion 200 is provided with a first partition member 210, a second partition member 220, and a support member 230.

The first partition member 210 forms the boundary between the heat exchange reduction portion 200 and the first accommodation space A, and is provided to match with a first partition wall 14 of the cover 10 in a state where a main partition wall 12 of the cover 10 matches with the heat exchange reduction portion 200 upon coupling the cover 10.

The first partition member 210 separates between the first accommodation space A and the second accommodation space B such that the second accommodation space B in which relatively high-temperature coolant is accommodated and the first accommodation space an in which low-temperature coolant is accommodated do not directly contact, which is such that the heat of the coolant accommodated in the second accommodation space B does not affect the coolant accommodated in the first accommodation space A.

The second partition member 220 forms the boundary between the heat exchange reduction portion 200 and the second accommodation space B, and is provided to be the same as the first partition member 210.

Furthermore, the second partition member 220 is provided to match with a second partition wall 16 of the cover 10 in a state where the main partition wall 12 of the cover 10 matches with the heat exchange reduction portion 200 when the cover 10 is coupled.

The second partition member 220 separates between the second accommodation space B and the first accommodation space A such that the first accommodation space A in which relatively low-temperature coolant is accommodated and the second accommodation space B in which high-temperature coolant is accommodated do not directly contact, that is, such that the heat of the coolant accommodated in the first accommodation space A does not affect the heat of the coolant accommodated in the second accommodation space B.

Furthermore, the support member 230 is formed on a center portion of a lower portion of the tank portion 100 that connects the first accommodation space A to the second accommodation space B, and supports the first partition member 210 and the second partition member 220.

The support member 230 has the center portion of the heat exchange reduction portion 200 that has a predetermined length and extends to the main partition wall 12 to partition regions on one side and the other side into the first accommodation space A and the second accommodation space B to support the first partition member 210 and the second partition member 220 together, forming a pair of separation spaces A', B' therein.

The support member 230 has the same length as the lengths in the width direction thereof in internal spaces of the first partition member 210 and the second partition member 220, that is, the pair of separation spaces A', B', and is formed to be gradually inclined downward toward the discharge portions 300 formed on the first partition member 210 and the second partition member 220.

In other words, as illustrated in FIG. 2, the discharge portions 300 face each other in the longitudinal directions of the first partition member 210 and the second partition member 220 and are formed to be tilted to one side, and at the instant time, the support portion 230 may be formed to be inclined downward toward the discharge portion 300 in a state of supporting the first partition member 210 and the second partition member 220.

Therefore, the coolants flowing into the separation spaces A', B' formed in the first partition member 210 and the second partition member 220, and selectively flowing into the separation spaces A', B' may move along the slope of the support member 230 to be discharged back to the first accommodation space A and the second accommodation space B, respectively, through the discharge portions 300.

Here, as illustrated in FIG. 3, the support member 230 may also be formed to allow inclined surfaces S of portions where the discharge portions 300 are formed to be inclined downward toward the first accommodation space A and the second accommodation space B such that the coolants flowing into the separation spaces A', B' may be discharged back to each of the first accommodation space A and the second accommodation space B more effectively.

To the present end, the discharge portions 300 are formed on the first partition member 210 and the second partition member 220, respectively, to have lengths from the bottom surface of the support member 230 to the boundary of the cover 10, more specifically, lengths up to the first partition wall 14 and the second partition wall 16, and as illustrated in FIG. 4, are preferably formed at positions higher than a position of the maximum coolant line (MAX) provided in the tank portion 100.

If the positions of the discharge portions 300 are formed at the positions lower than the maximum coolant line (MAX), the coolants frequently flow into the separation spaces A', B' and therefore, the heat exchange by the coolants with different temperatures may be inevitably conducted between the first accommodation space A and the second accommodation space B. To prevent such a situation, it is possible to allow the discharge portions 300 to be formed at the positions higher than the maximum coolant line (MAX), reducing the heat exchange.

Furthermore, since the support member 230 is formed to be inclined downwardly from the end portion of the heat exchange reduction portion 200 up to the position corresponding to the maximum coolant line (MAX) (see FIG. 4), the coolants may be discharged to the first accommodation space A and the second accommodation space B along the inclined space S even when flowing into the separations spaces A', B'.

Meanwhile, the tank portion 100 does not generally have the coolant filled in the entire region thereof but an air collection space may be provided in the remaining space at a predetermined rate.

Therefore, it may be difficult to reduce the size of the tank portion 100 by the air collection space.

To the present end, according to the exemplary embodiment of the present invention, the heat exchange of the coolant may be reduced by mounting the first partition member 210 and the second partition member 220 in the tank portion 100 where the coolants with different temperatures are accommodated and stored, respectively, and the air collection space may extend by also mounting the discharge portions 300 in the first partition member 210 and the second partition member 220, respectively to flow the air in the first accommodation space A and the second accommodation space B into the separation spaces A', B' through the discharge portion 300.

Therefore, it is possible to save the air collection space by the sizes of the separation spaces A', B' in the tank portion 100, and as a result, to reduce the size of the tank portion 100 having the size, which extends by accommodating the coolants with two different temperatures, that is, formed by connecting two reservoir tanks by the saved air collection space.

Here, according to the exemplary embodiment of the present invention, it is difficult to play an individual role due to the heat exchange when two tank portions 100 are connected as described above.

For example, in case of the electric vehicle, the type, temperature conditions, etc. of the coolant required by the cooling circuit configured to cool the electronic portions and the type, temperature conditions, etc. of the coolant required by the cooling circuit configured to cool the battery are different from each other, it is not possible to satisfy the condition of the corresponding cooling circuit when the heat exchange is conducted.

As a result, according to the exemplary embodiment of the present invention, if the coolants accommodated in the first accommodation space A and the second accommodation space B flow into the separation spaces A', B' through the discharge portions 300 by the shaking, tilting, etc. of the vehicle in the state where the discharge portions 300 are provided for extending the air collection space, the coolants may be discharged again along the inclined surfaces S of the discharge portions 300, reducing the heat delivery between the first accommodation space A and the second accommodation space B, and preventing the problem caused by the dissatisfaction of the condition of the cooling circuit.

The present invention may apply the heat exchange reduction structure to the plurality of reservoir tanks in which the coolants having different temperatures are each accommodated to satisfy the cooling performance of different components to integrate the reservoir tanks, reducing the weight and material cost of the reservoir tank, and preventing the reduction in performance due to the heat exchange of the coolant.

Furthermore, the present invention may have the discharge portion in the heat exchange reduction structure, and allow the air in the reservoir tank to flow into the heat exchange reduction structure through the discharge portion to distribute the air required by the reservoir tank to the heat exchange reduction structure, reducing the volume of the reservoir tank.

Furthermore, the present invention may discharge the coolant back into the reservoir tank through the slope of the discharge portion if the coolant flows into the heat exchange reduction structure by the cause, such as the shaking or tilting of the vehicle, also reducing the heat delivery in the heat exchange reduction structure.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A reservoir tank for a vehicle, the reservoir tank comprising:

a tank portion into which coolants with different temperatures are supplied, wherein a cover is coupled to an upper portion of the tank portion;

a heat exchange reduction portion partitioning an internal space of the tank portion into a first accommodation space and a second accommodation space, wherein the first accommodation space and the second accommodation space are spaced from each other in the internal space of the tank portion; and a discharge portion provided in the heat exchange reduction portion and formed to allow coolant flowing into the heat exchange reduction portion to be discharged back to the first accommodation space and the second accommodation space, respectively, wherein the heat exchange reduction portion includes:

a first partition member forming a boundary with the first accommodation space;

a second partition member forming a boundary with the second accommodation space; and a support member supporting the first partition member and the second partition member inside the tank portion, and wherein the support member is formed to be inclined downward toward the first accommodation space and the second accommodation space, respectively, at a position where the discharge portion is formed.

2. The reservoir tank of claim 1, wherein the support member is formed on a center portion of a lower portion of the tank portion that connects the first accommodation space to the second accommodation space, and supports the first partition member and the second partition member.

3. The reservoir tank of claim 1, wherein the discharge portion is formed on each of the first partition member and the second partition member.

4. The reservoir tank of claim 1, wherein the support member is formed to be inclined downward toward the discharge portion in an internal space of the first partition member and an internal space of the second partition member.

5. The reservoir tank of claim 2, wherein the discharge portion is formed to have a length from a bottom surface of the support member up to a boundary surface with the cover.

6. The reservoir tank of claim 1, wherein the discharge portion is formed at a position higher than a maximum coolant line provided in the tank portion to allow an air in the first accommodation space and the second accommodation space to flow into the heat exchange reduction portion.

7. The reservoir tank of claim 1, wherein the first partition member forms the boundary between the heat exchange reduction portion and the first accommodation space, and is provided to match with a first partition wall of the cover in a state where a main partition wall of the cover matches with the heat exchange reduction portion when the cover is coupled to the tank portion, and wherein the second partition member forms the boundary between the heat exchange reduction portion and the second accommodation space and the second partition member is provided to match with a second partition wall of the cover in a state where the main partition wall of the cover matches with the heat exchange reduction portion when the cover is coupled to the tank portion.

8. The reservoir tank of claim 7, wherein first and second discharge portions are formed on the first partition member and the second partition member, respectively, to have lengths from a bottom surface of the support member up to the first partition wall and the second partition wall.

9. The reservoir tank of claim 8, wherein the first and second discharge portions are formed at positions higher than a position of a maximum coolant line provided in the tank portion.

10. The reservoir tank of claim 9, wherein the support member is formed to be inclined downwardly from an end portion of the heat exchange reduction portion up to the position corresponding to the maximum coolant line.

* * * * *